US006489937B1

(12) United States Patent
Ruvinsky

(10) Patent No.: US 6,489,937 B1
(45) Date of Patent: Dec. 3, 2002

(54) LED MATRIX CONTROL SYSTEM WITH FIELD PROGRAMMABLE GATE ARRAYS

(75) Inventor: Boris Ruvinsky, Framingham, MA (US)

(73) Assignee: 3Com Corporation, Santa Clara, CA (US)

( * ) Notice: Subject to any disclaimer, the term of this patent is extended or adjusted under 35 U.S.C. 154(b) by 0 days.

(21) Appl. No.: 09/439,399

(22) Filed: Nov. 15, 1999

(51) Int. Cl.[7] ..... G09G 3/14
(52) U.S. Cl. ..... 345/46; 345/82
(58) Field of Search ..... 345/33, 34, 39, 345/46, 64, 55, 82, 44, 84; 340/815.45; 703/21, 24, 25, 28; 711/111–114; 712/27–31, 1

(56) References Cited

U.S. PATENT DOCUMENTS 5,574,930 A * 11/1996 Halverson et al. ..... 711/111
5,603,043 A * 2/1997 Taylor et al. ..... 712/1
5,903,624 A * 5/1999 Boswell et al. ..... 379/21
6,058,263 A * 5/2000 Voth ..... 703/25

* cited by examiner

*Primary Examiner*—Chanh Nguyen
(74) *Attorney, Agent, or Firm*—McGlew & Tuttle, P.C.

(57) ABSTRACT

An LED matrix control system using a plurality of FPGAs (Field Programmable Gate Array) in between a CPU and a LED matrix. One FPGA controls a first set of LED's and a second FPGA controls a second set of LED's. The first FPGA controls all of the column lines of an LED matrix, and controls a sub set of the row lines of the LED matrix. The second FPGA also controls all of the column lines and controls another sub set of the row lines. Each FPGA receives the same information from the CPU. Each FPGA also has a config line. The config line of one FPGA is connected to a logical zero, and the config line of the other FPGA is connected to a logical one. Each FPGA only enables or energizes one row at a time. The rows are energized on and off so quickly, that the human persistence of vision causes the appearance of the energized LED's to always appear lit. All of the LED's and in an LED matrix can be individually and separately controlled by two or more FPGA's which have identical programming, and can be programmed in parallel to reduce programming time.

12 Claims, 4 Drawing Sheets

NOR GATE

| INPUT | | | | | | OUTPUT |
|---|---|---|---|---|---|---|
| T1 | T2 | T3 | T4 | T5 | T6 | |
| 0 | 0 | 0 | 0 | 0 | 0 | 1 |
| 1 | 0 | 0 | 0 | 0 | 0 | 0 |
| 0 | 1 | 0 | 0 | 0 | 0 | 0 |
| 0 | 0 | 1 | 0 | 0 | 0 | 0 |
| 0 | 0 | 0 | 1 | 0 | 0 | 0 |
| 0 | 0 | 0 | 0 | 1 | 0 | 0 |
| 0 | 0 | 0 | 0 | 0 | 1 | 1 |
| 1 | 0 | 0 | 0 | 0 | 0 | 0 |

FIG 3

| | | | | | | | | | | | |
|---|---|---|---|---|---|---|---|---|---|---|---|
| A13GR | A13YL | A14GR | A14YL | A15GR | A15YL | A16GR | A16YL | A17GR | A17YL | A18GR | A18YL |
| A7GR | A7YL | A8GR | A8YL | A9GR | A9YL | A10GR | A10YL | A11GR | A11YL | A12GR | A12YL |
| A1GR | A1YL | A2GR | A2YL | A3GR | A3YL | A4GR | A4YL | A5GR | A5YL | A6GR | A6YL |
| B13GR | B13YL | B14GR | B14YL | B15GR | B15YL | B16GR | B16YL | B17GR | B17YL | B18GR | B18YL |
| B7GR | B7YL | B8GR | B8YL | B9GR | B9YL | B10GR | B10YL | B11GR | B11YL | B12GR | B12YL |
| B1GR | B1YL | B2GR | B2YL | B3GR | B3YL | B4GR | B4YL | B5GR | B5YL | B6GR | B6YL |

FIG. 4

LED MATRIX CONTROL SYSTEM WITH FIELD PROGRAMMABLE GATE ARRAYS

FIELD OF THE INVENTION

The present invention relates to the field of controlling the individual LED's in a matrix of LED's, and in particular to a system using two field programmable gate arrays (FPGA).

BACKGROUND OF THE INVENTION

In many electronic devices, an LED matrix is used to display information regarding the device. In a computer network devices, a central processing unit (CPU) often determines which LED's are to be on and off, and does this by writing a data word to a specific address. The data word indicates the state, on or off, and the address corresponds to a particular LED. Electronic components must then be used between the CPU and the LED matrix. These components must be able to convert the address and data information into specific electrical currents that energize or enable the individual LED's. The number of LED's in a matrix can vary, as well as the arrangement of the LED's in a matrix. As an example, an LED matrix of 36 LED's can be arranged in two rows with 18 columns, three rows with 12 columns, four rows with nine columns, and six rows with six columns. Therefore the components between the CPU and the LED matrix changes for each LED matrix having a different number of LED's, or having a different arrangement of LED's.

SUMMARY AND OBJECTS OF THE INVENTION

One of the objects of the present invention is to provide an LED matrix control system where the same component can be used for several differently sized and arranged LED matrixes. This object is accomplished by using an FPGA (Field Programmable Gate Array) in between the CPU and the LED matrix. The program for the FPGA is downloaded into the FPGA from the CPU at startup of the device.

It is another object of the present invention to reduce the size of the program for the FPGA, and to reduce the time needed to program the FPGA. The present invention accomplishes this object by using two FPGA's, where one FPGA controls a first set of LED's and the second FPGA controls a second set of LED's. The first set and the second set of LED's are preferably mutually exclusive.

In a preferred embodiment, the first FPGA controls all of the column lines of an LED matrix, and controls a sub set of the row lines of the LED matrix. The second FPGA also controls all of the column lines and controls another sub set of the row lines. Each FPGA receives the same information from the CPU. Each FPGA also has a config line. The config line of one FPGA is connected to a logical zero, such as ground, and the config line of the other FPGA is connected to a logical one, such as a power supply voltage. Each FPGA only enables or energizes one row at a time. The rows are energized on and off so quickly, that the human persistence of vision causes the appearance of the energized LED's to always appear lit.

Each FPGA includes a row control means which controls which rows are energized. The row control means in each FPGA is based on the same clock signal, preferably the clock signal coming from the CPU. From this clock signal, row signals are generated. Each row signal separately indicates which row is to be energized. Each FPGA generates a separate row signal for each of the rows in the LED matrix, regardless of whether the respective FPGA will control that row. Each of the row signals in each FPGA also generates an indication of when the respective row is to be enabled, regardless of whether the respective FPGA controls that row. Each FPGA also includes a time logic block which receives the row signals and generates row subset signals. The time logic block also receives the config signal. Based on the config signal, the time logic block chooses which of the row signals to include in the row subset signals. As an example, if the config signal is at a logical one level, the time logic block includes only the row signals for the first set of rows in the row subset signals. If the config signal is at a logical zero level, the time logic block includes only the row signals for the second set of rows in the row subset signals.

Each FPGA also includes an LED register array and generates individual LED signals for each of the LED's in the LED matrix based on the information received from the CPU. Each LED register array receives the same signals from the CPU. Each LED register array also receives the config signal. Based on the config signal, each LED register array generates the individual LED signals for either the first or second set of rows in the LED matrix.

In order to enable or energized one LED, the row and column lines for that one LED must be enable. When one of the row subset signals is enabled in an FPGA, the FPGA enables the respective row. When one of the individual LED signals is enabled in an FPGA, and the row subset signal of that one individual LED is also enabled, the FPGA enables the column line for that one individual LED. In this way, all of the LED's and in an LED matrix can be individually and separately controlled by two or more FPGA's which have identical programming, and can be programmed in parallel to reduce programming time. Also the size of the FPGAs can be smaller and it is often more cost-effective to use two smaller FPGA's then one large FPGA. The present invention is therefore able to provide an LED matrix control system which is simple in design, reliable during operation and economical to manufacture.

The various features of novelty which characterize the invention are pointed out with particularity in the claims annexed to and forming a part of this disclosure.

For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 3 is a logic diagram for a nor gate;

FIG. 4 is a schematic representation of the preferred LED matrix.

DESCRIPTION OF THE PREFERRED EMBODIMENT

Figure 1:
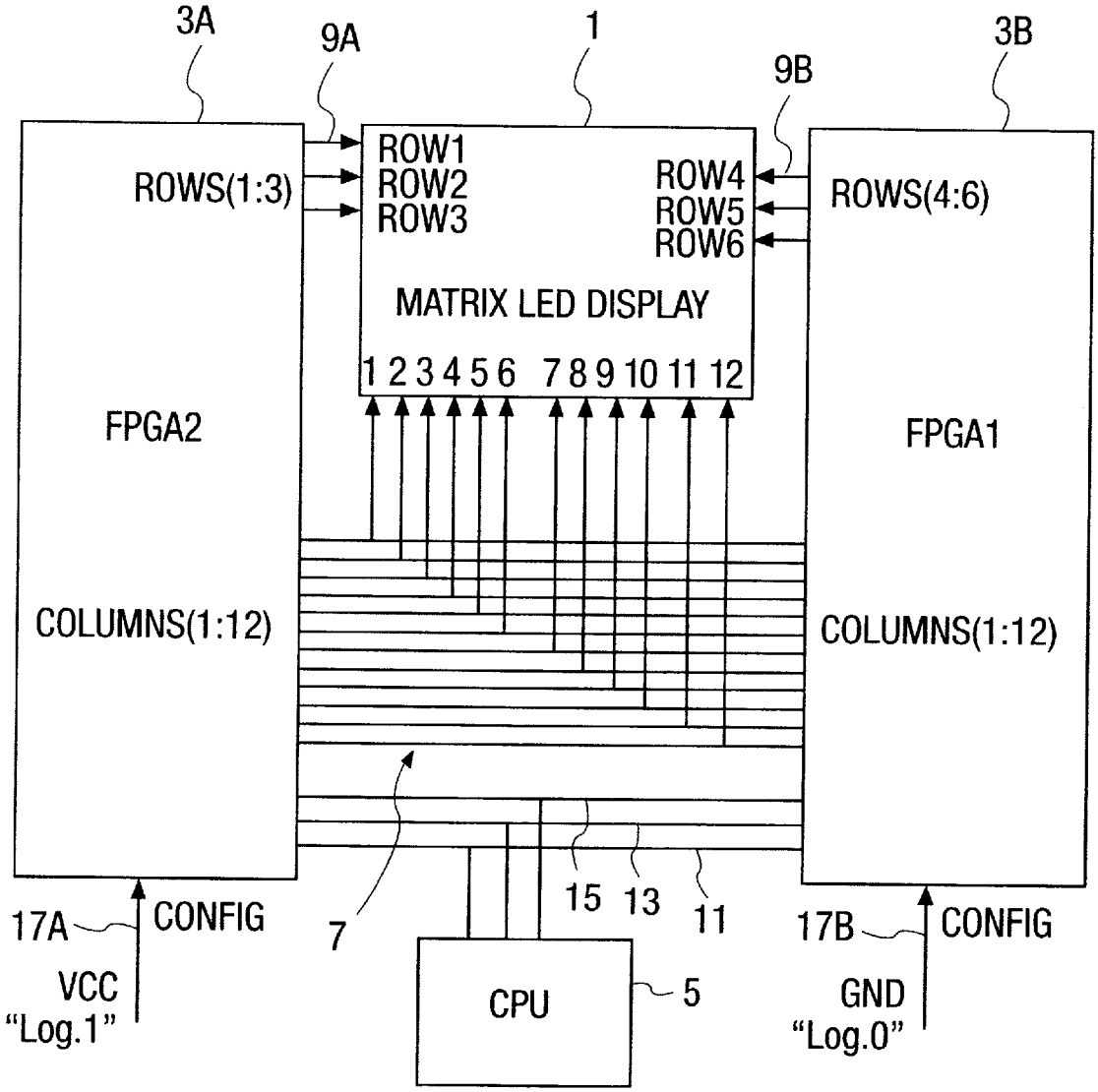
FIG. 1 is a schematic diagram of the LED matrix control system.

Referring to the drawings, and in particular to FIG. 1, a matrix LED display, or LED matrix 1 is connected to first and second FPGAs 3A and 3B. A preferred type of FPGA is model EPF6016TC144-3, from ALTERA Corp. and a preferred type of LED matrix is model SEL-7588M, Selectronic Ltd., from LITEON ELECTRONIC CO., Ltd. The FPGAs 3 are connected to CPU 5, preferably Motorola MPC 860. The FPGA's 3 have control outputs connected to the LED matrix 1 through a plurality of column lines 7 and row lines 9A and 9B. In particular FPGA 3A is connected to LED matrix 1 with row lines 9A, and FPGA 3B is connected to LED matrix 1 with row lines 9B. The FPGAs 3 are both connected to all of the column lines 7. The FPGAs 3 are connected to the CPU 5 by an address line 11, data line 13 and clock line 15. As can be seen from FIG. 1, the FPGAs 3 share the same address line 11, data line 13 and clock line 15. Programming of the FPGAs 3 can be done by the CPU 5, or an optional memory device such as an EPROM, not shown. The programming of the FPGAs 3 can be through the address line 11, data lines 13 and clock line 15, or the programming can be performed through a separate lines not shown in the figures. Each FPGA 3 is programmed with the same programming code and both of the FPGAs 3 can be programmed simultaneously from the same source.

Each FPGA 3 also includes a separate config input 17A or 17B. Config input 17A is preferably tied by hardware to a logical one, usually a power supply voltage. Config input 17B is preferably tied by hardware to a logical zero, usually ground. The program code in the FPGAs 3 read the signal on the config input 17 and use this signal to determine which rows 9 and respective LEDs, the FPGA 3 is to control.

FIG. 4 individually shows the placement of the LEDs in the LED matrix 1. In the preferred embodiment, the LED matrix 1 includes 36 bi-color LEDs, where each bi-color LED can display yellow or green light. Therefore the LED matrix one can be considered to have 72 different LEDs or lights. In FIG. 4, the terms starting with the letter A are controlled by FPGA 3A, and the terms starting with the letter B are controlled by FPGA 3B. The number following the letter indicates the number of the bi-color LED and the two letters after the number indicates if the term represents the green or yellow portion of the bi-color LED. Row 1 therefore includes the bi-color LEDs 13—18 of the first set and they are controlled by FPGA 3A. Likewise row 2 includes bi-color LEDs 7—12 of the first set and they are also controlled by FPGA 3A. Row 4 includes bi-color LEDs 13–18 of the second set and they are controlled by FPGA 3B.

Figure 2:
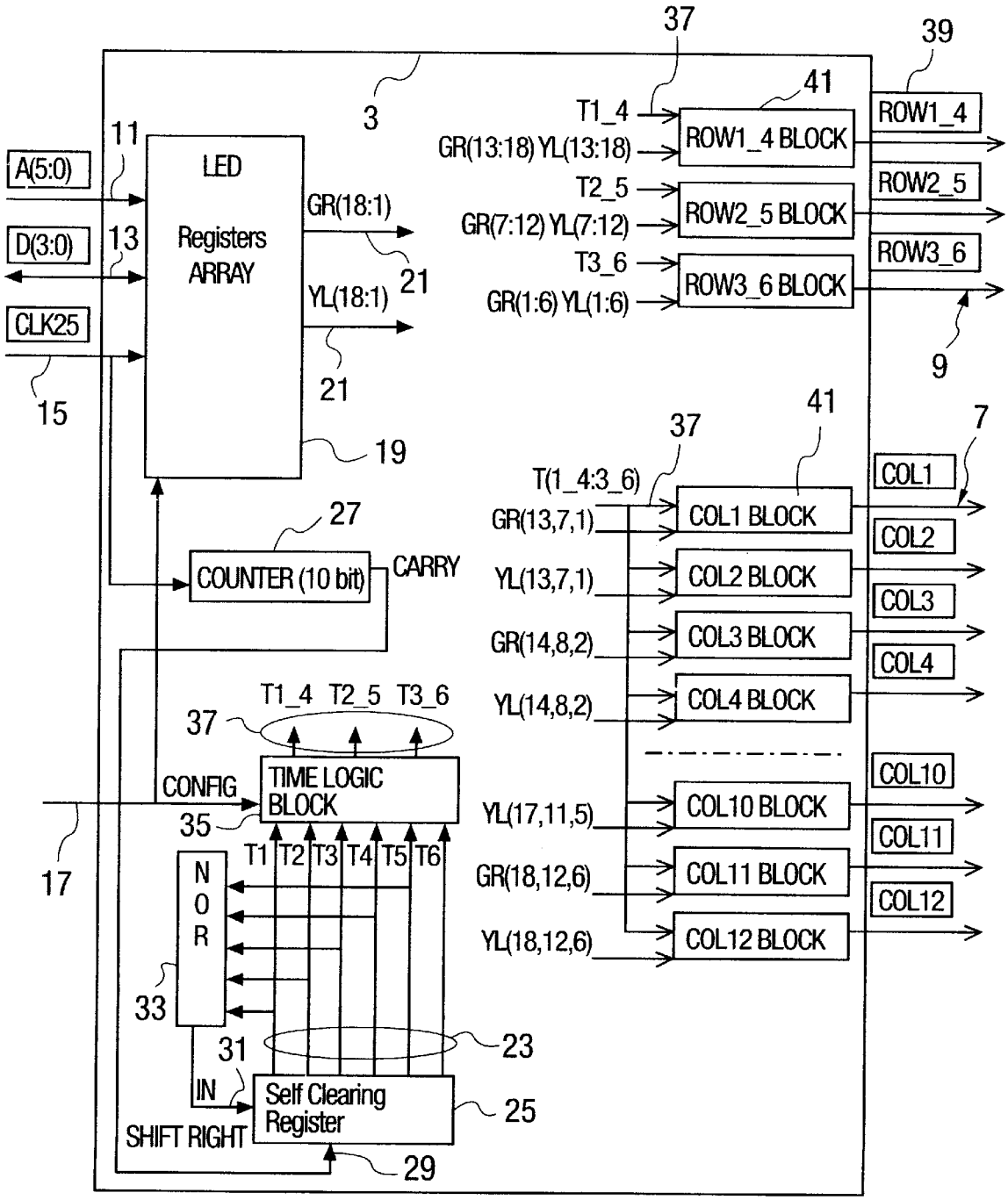
FIG. 2 is a schematic diagram and of one FPGA.

As shown in FIG. 2, each FPGA 3 includes an LED register array 19 which receives the address line 11, data line 13, clock line 15 and config line 17. The LED register array 19 reads all of these lines and generates individual LED signals 21. Each individual LED signal 21 indicates the state, on or off, of an individual LED. The individual LEDs themselves are divided into the two sets, preferably with one set corresponding to the first set of rows 9, and the other set of LEDs corresponding to another set of rows 9. The LED register array 19 generates the individual LED signals 21 for the specific set of LEDs based on the value of the signal on the config input 17. In FIG. 2, the individual LED signals 21 are divided into LED signals for the green portion of the bi-colored LEDs and the yellow portion of the bi-colored LEDs.

Each FPGA 3 controls one of the subset of row lines 9 by a row control means. In the example shown in FIG. 1, FPGA 3A controls row lines 9A, which includes rows 1–3. The other FPGA 3B controls row lines 9B with rows 4–6. Regardless of which rows an FPGA 3 controls, each FPGA 3 generates row signals 23 for all of the rows 9. When one of the row signals 23 is enabled, this indicates that the corresponding row in the LED matrix 1 should also be enabled. The row signals 23 are preferably enabled separately and sequentially. However the row signals 23 can be enabled in any order desired.

The row signals 23 are preferably generated with the clock signal 15 and a self clearing shift register 25. A 10 bit counter 27 can be placed between the clock signal 15 and the self clearing shift register 25 in order to reduce the speed of the clock. A carry signal from counter 27 is connected to the shift right input 29. The output of the self clearing register 25 are the row signals 23. All but one of the row signals 23 are separately combined in a nor gate 33. The output of the nor gate 33 is connected to the data input 31 of the shift register 25. FIG. 3 shows how the combination of the self clearing shift register 25 and the nor gate 33 combine to enable only one row signal 23 at a time. When the FPGA is started for the first time, all the bits in the register 23 are zero, and therefore the output of the nor gate 33 is one. This value of one is then entered into the data input 31 of the shift register 25, and enables row signal T1. During the next shift cycle, as shown by the second line in FIG. 3, one of the inputs to the nor gate 33 is a logical one, and therefore the output of the nor gate 33 is zero. This zero is then placed into the shift register 25 and all the previous values in the shift register are moved one bit with the result as shown in line three of FIG. 3. Each row line 23 is thus separately enabled in a sequential matter.

However each FPGA 3 does not enable or control all of the row lines 9. Therefore the row signals 23 are delivered to a time logic block 35. The time logic block 35 also receives the config signal 17, and uses the config signal 17 with the row signals 23 to generate row subset signals 37 which only control the row lines 9 which the respective FPGA 3 is supposed to control. The logic for the row sub set signals is shown below:

Ti_4←(T1 and Config) or (T4 and NOT(Config))

T2_5←(T2 and Config) or (T5 and NOT(Config))

T3_6←(T3 and Config) or (T6 and NOT(Config)).

In this way, the row subset signals 37 are only enabled when the row to be enabled is a row controlled by the respective FPGA 3.

The row subset signals 37 are then fed to row enabling units 39 which enable or energize a row line 9 when the corresponding row subset signal 37 is energized. In a preferred embodiment, a row logic block 41 is placed between each corresponding row subset signal 37 and its corresponding row enabling unit 39. The logic of each row logic block 41 is shown below.

ROW1_4=T1_4 and (GR13 or GR14 or GR15 or GR16 or GR17 or GR18 or YL13 or YL14 or YL15 or YL16 or YL17 or YL18)

ROW2_5=T2_5 and (GR7 or GR8 or GR9 or GR10 or GR11 or GR12 or YL7 or YL8 or YL9 or YL10 or YL11 or YL12)

ROW3_6=T3_6 and (GR1 or GR2 or GR3 or GR4 or GR5 or GR6 or YL1 or YL2 or YL3 or YL4 or YL5 or YL6).

These row logic blocks 41 prevents a row from being energized or enabled when none of the LEDs in that row are to be enabled. The nor gate 33, shift register 25, time logic block 35 row logic blocks 41 and row enabling units 39 form the preferred embodiment of the row control means. However other embodiments are possible and within the scope of the invention.

The enabling of the column lines 7 is performed by column control means which includes all the structure generating the row subset signals 37, and column logic blocks 41. Column logic blocks 41 receive both the individual LED signals 21 and the row subset signals 37. In particular, each column logic block 41 receives all of the row subset signals 37 and the individual LED signals 21 for the LEDs in the respective column. The logic in each respective column logic block 41 then determines if the corresponding column in the LED matrix I should be enabled. The logic for the column logic blocks in the preferred embodiment is as follows:

COL1=((T3_6 and GR1) or (T2_5 and GR7) or (T1_4 and GR13))

COL2=((T3_6 and YL1) or (T2_5 and YL7) or (T1_4 and YL13))

COL3=((T3_6 and GR2) or (T2_5 and GR8) or (T1_4 and GR14))

COL4=((T3_6 and YL2) or (T2_5 and YL8) or (T1_4 and YL14))

COL5=((T3_6 and GR3) or (T2_5 and GR9) or (T1_4 and GR15))

COL6=((T3_6 and YL3) or (T2_5 and YL9) or (T1_4 and YL15))

COL7=((T3_6 and GR4) or (T2_5 and GR10) or (T1_4 and GR16))

COL8=((T3_6 and YL4) or (T2_5 and YL10) or (T1_4 and YL16))

COL9=((T3_6 and GR5) or (T2_5 and GR11) or (T1_4 and GR17))

COL10=((T3_6 and YL5) or (T2_5 and YL11) or (T1_4 and YL17))

COL11=((T3_6 and GR6) or (T2_5 and GR12) or (T1_4 and GR18))

COL12=((T3_6 and YL6) or (T2_5 and YL12) or (T1_4 and YL18)).

Each column line 7 is therefore only enabled if an individual LED signal 21 is enabled for one of the LEDs in the respective column, and if the row line 9A for that LED is enabled.

By designing an FPGA 3 according to the above disclosure, a plurality of FPGA's 3 can be used to control a plurality of LEDs in an LED matrix, where the program code for the plurality of FPGA's 3 is identical for all of the FPGAs 3. Also, all of the FPGAs 3 can be programmed simultaneously. The internal design of the FPGA 3, including alternate expressions of the logic can be changed, and still fall within the scope of the invention of having the program code for the FPGAs be identical and simultaneously programmable.

While specific embodiments of the invention have been shown and described in detail to illustrate the application of the principles of the invention, it will be understood that the invention may be embodied otherwise without departing from such principles.

What is claimed is:

1. A light emitting diode (LED) matrix control system, comprising:

a matrix LED display including a plurality of LEDs controlled by a plurality of row lines and a plurality of column lines;

a first field programmable gate array (FPGA) with a first FPGA programming input and first control outputs connected to said matrix LED display;

a second FPGA with a second FPGA programming input and second control outputs connected to said matrix LED display, said second FPGA being substantially identical to said first FPGA, said control outputs of said FPGAs being connected to said plurality of row and column lines;

a central processing unit(CPU) connected to said first FPGA via said first FPGA programming input and connected to said second FPGA via said second FPGA programming input with said first FPGA programming input and said second FPGA programming input being connected to said CPU in parallel and being programmed as one FPGA, each of said FPGAs including column control means for only enabling said column lines when one of said LEDs in a respective said column line is to be enabled and a respective said row line of said one LED is enabled.

2. The system in accordance with claim 1, wherein:

said CPU programs said first and second FPGA in parallel.

3. The system in accordance with claim 1, wherein:

said CPU programs said first and second FPGA with identical programming code.

4. The system in accordance with claim 1, wherein:

said first and second FPGA include config inputs, said config input of said first FPGA being connected to a logical zero, said config input of said second FPGA being connected to a logical one.

5. The system in accordance with claim 1, wherein:

each of said column lines are connected to said control outputs of both of said FPGAs.

6. The system in accordance with claim 1, wherein:

each of said FPGAs include row control means for individually and separately enabling said row lines.

7. The system in accordance with claim 1, wherein:

each of said FPGAs include an LED register array connected to said CPU by a data line and an address line, said LED register array of said first FPGA generating a plurality of individual LED signals, each of said individual LED signals indicating a state of one of a first set of said LEDs, said LED register array of said second FPGA having a plurality of individual LED signals, each of said individual LED signals of said LED register array of said second FPGA indicating a state of one of a second set of said LEDs.

8. A system in accordance with claim 1, wherein, said first FPGA and said second FPGA are both programmed to drive said matrix LED display.

9. A light emitting diode (LED) matrix control system, comprising:

a matrix LED display;

a first field programmable gate array (FPGA) with a first FPGA programming input and first control outputs connected to said matrix LED display;

a second FPGA with a second FPGA programming input and second control outputs connected to said matrix LED display, said second FPGA being substantially identical to said first FPGA;

a central processing unit(CPU) connected to said first FPGA via said first FPGA programming input and connected to said second FPGA via said second FPGA programming input with said first FPGA programming input and said second FPGA programming input being connected to said CPU in parallel and being programmed as one FPGA;

said matrix LED display includes a plurality of LEDs controlled by a plurality of row lines acid a plurality of column lines;

said control outputs of said FPGAs are connected to said plurality of row and column lines;

said control outputs of said first FPGA are connected to a first set of said plurality row lines;

said control outputs of said second FPGA are connected to a second set of said plurality row lines, said first and second sets of said plurality of lines being mutually exclusive.

10. The system in accordance with claim 9, wherein:

each of said column lines are connected to said control outputs of both of said FPGAs.

11. The system in accordance with claim 10, wherein:

said first and second FPGA include config inputs, said config input of said first FPGA being connected to a logical zero, said config input of said second FPGA being connected to a logical one;

each of said FPGAs including row control means for individually and separately enabling said row lines;

each of said FPGAs including column control means for only enabling said column lines when one of said LEDs in a respective said column line is to be enabled and a respective said row line of said one LED is enabled;

said CPU programs said first and second FPGAs with identical programming code.

12. A light emitting diode (LED) matrix control system, comprising:

a matrix LED display;

a first field programmable gate array (FPGA) with a first FPGA programming input and first control outputs connected to said matrix LED display;

a second FPGA with a second FPGA programming input and second control outputs connected to said matrix LED display, said second FPGA being substantially identical to said first FPGA;

a central processing unit(CPU) connected to said first FPGA via said first FPGA programming input and connected to said second FPGA via said second FPGA programming input with said first FPGA programming input and said second FPGA programming input being connected to said CPU in parallel and being programmed as one FPGA, each of said FPGAs include an LED register array connected to said CPU by a data line and an address line, said LED register array of said first FPGA generating a plurality of individual signals, each of said individual LED signals indicating a state of one of a first set of said LEDs, said LED register array of said second FPGA having a plurality of individual LED signals, each of said individual LED signals of said LED register array of said second FPGA indicating a state of one of a second set of said LEDs.

* * * * *